United States Patent [19]

Gabbay et al.

[11] Patent Number: 4,602,382

[45] Date of Patent: Jul. 22, 1986

[54] ELECTRO-ACOUSTIC TRANSDUCER ASSEMBLY

[75] Inventors: Moses A. Gabbay, Chestnut Hill; Sang O. Oum, Wilmington, both of Mass.

[73] Assignee: Boston Acoustics, Inc., Peabody, Mass.

[21] Appl. No.: 665,297

[22] Filed: Oct. 26, 1984

[51] Int. Cl.[4] ..... H04R 1/02

[52] U.S. Cl. ..... 381/90; 179/146 R; 179/146 E; 381/86

[58] Field of Search ..... 381/90, 89, 86; 179/146 R, 146 E, 179

[56] References Cited

U.S. PATENT DOCUMENTS

| | | | |
|---|---|---|---|
| 4,032,725 | 6/1977 | McGee | 179/146 R |
| 4,072,829 | 2/1978 | Ogihara | 179/146 R |
| 4,281,224 | 7/1981 | Castagna | 381/86 |
| 4,439,643 | 3/1984 | Schweizer | 179/146 E |
| 4,503,292 | 3/1985 | Johnson et al. | 179/146 R |

*Primary Examiner*—Gene Z. Rubinson

*Assistant Examiner*—Danita R. Byrd

*Attorney, Agent, or Firm*—Schiller & Pandiscio

[57] ABSTRACT

An electro-acoustic transducer assembly includes a permanent magnet and a diaphragm having a voice coil bonded thereto. The assembly comprises a hollow casing having an opening formed in one surface thereof; a closure for covering the opening and comprising an aperture therein in which the diaphragm is mounted, and a cover mounted on one side of the closure for protecting the diaphragm, wherein the magnet is positioned on the opposite side of the closure in proximity to the voice coil on the diaphragm. The assembly also includes a latching assembly for releasably securing the closure across the opening in the casing in a latched position with the cover being positioned to the exterior of the assembly and the magnet being positioned in the casing, the latching assembly being operable by application of pressure at preselected locations on the periphery of said casing to release the closure from the latched position. The closure is elastically biased away from the opening of the casing upon release of the closure from the latched position, upon application of the pressure.

12 Claims, 7 Drawing Figures

ELECTRO-ACOUSTIC TRANSDUCER ASSEMBLY

The present invention relates generally to electro-acoustic transducer assemblies, and, more particularly, to an improved housing structure for supporting and protecting an electro-acoustic transducer, such as the type of transducer typically used in automobiles for audio reproduction.

Small electro-acoustic transducers, such as those types adapted to be used in an automobile for reproducing audio sound, are often mounted in doors, on or under dashboards, back seat shelves, etc. Such transducers may be subjected to severe adverse environmental conditions, such as large temperature changes, dust, vibration, etc., as well as subjected to accidental damage, particularly if left unprotected. It is, accordingly, desirable to protect these transducers, as much as possible from these adverse conditions and any accidental damage by enclosing the transducer in some type of housing. The housing should not only be constructed so that the transducer is protected but also easily mountable at various locations, such as those typically used in automobiles for supporting such transducers.

Accordingly, an object of the present invention is to provide an improved electro-acoustic transducer assembly.

Another object of the present invention is to provide an improved housing for an electro-acoustic transducer.

And another object of the present invention is to provide an improved electro-acoustic transducer assembly particularly adapted to be easily mounted and used at various locations within an automobile.

Yet another object of the present invention is to provide a sturdy, impact-resistant electro-acoustic transducer assembly which is easy to assemble, mount and disassemble.

Still another object of the present invention is to provide an inexpensive electro-acoustic transducer assembly particularly adapted for use in automobiles.

These and other objects are achieved by an improved electro-acoustic transducer assembly including a permanent magnet and a diaphragm having a voice coil bonded thereto. The assembly comprises, in combination:

- a hollow casing having an opening formed in one surface thereof;
- closure means for covering the opening and comprising an aperture therein in which the diaphragm is mounted, cover means mounted on one side of the closure means for protecting the diaphragm, and means for positioning the magnet on the opposite side of the closure means in proximity to the voice coil on the diaphragm;
- latching means for releasably securing the closure means across the opening in the casing in a latched position with the cover means being positioned to the exterior of the assembly and the magnet being positioned in the casing, the latching means being operable by application of pressure at preselected locations on the periphery of the casing to release the closure means from the latched position; and
- means for elastically biasing the closure means away from the opening of the casing upon release of the closure means from the latched position, upon application of the pressure.

Other objects of the invention will in part be obvious and will in part appear hereinafter. The invention, accordingly, comprises the product possessing the feature, properties and relation of components which are exemplified in the following detailed disclosure, and the scope of the application of which will be indicated in the claims.

For a fuller understanding of the nature and objects of the present invention, reference should be had to the following detailed description taken in connection with the accompanying drawings, wherein.

Figure 3:
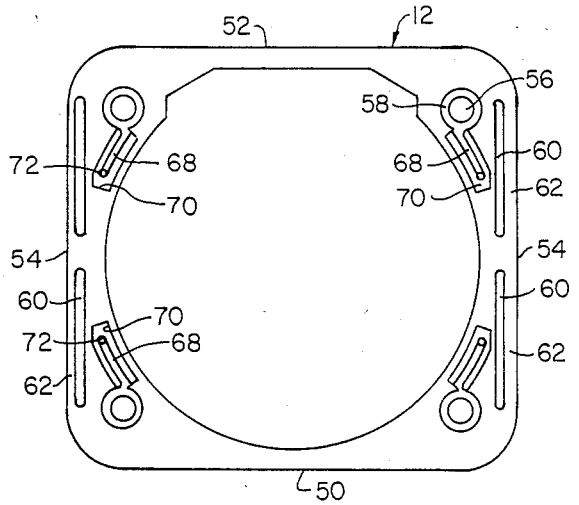
FIG. 3 shows a plan view of the bracket of the preferred embodiment of the electro-acoustic transducer assembly of the present invention.
Figure 4:
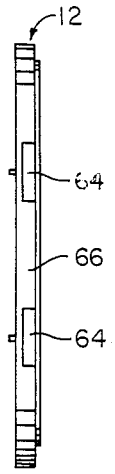
FIG. 4 shows a side view of the bracket shown in FIG. 3.

Referring to the drawings, the preferred embodiment of the electro-acoustic transducer assembly includes a casing 10 (shown in FIGS. 1, 2 and 7), mounting bracket 12 (FIGS. 2, 3, and 4) and closure means 14 (FIGS. 1, 5, 6 and 7).

Figure 1:
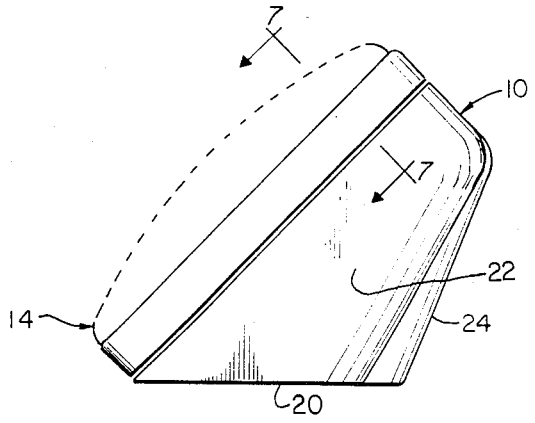
FIG. 1 shows a side view of the preferred embodiment of the electro-acoustic transducer assembly of the present invention, assembled for use.
Figure 7:
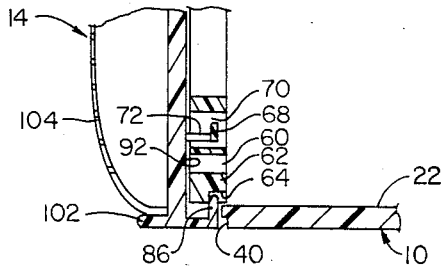
FIG. 7 is a partial cross-sectional view taken along line 7—7 of FIG. 1.
Figure 2:
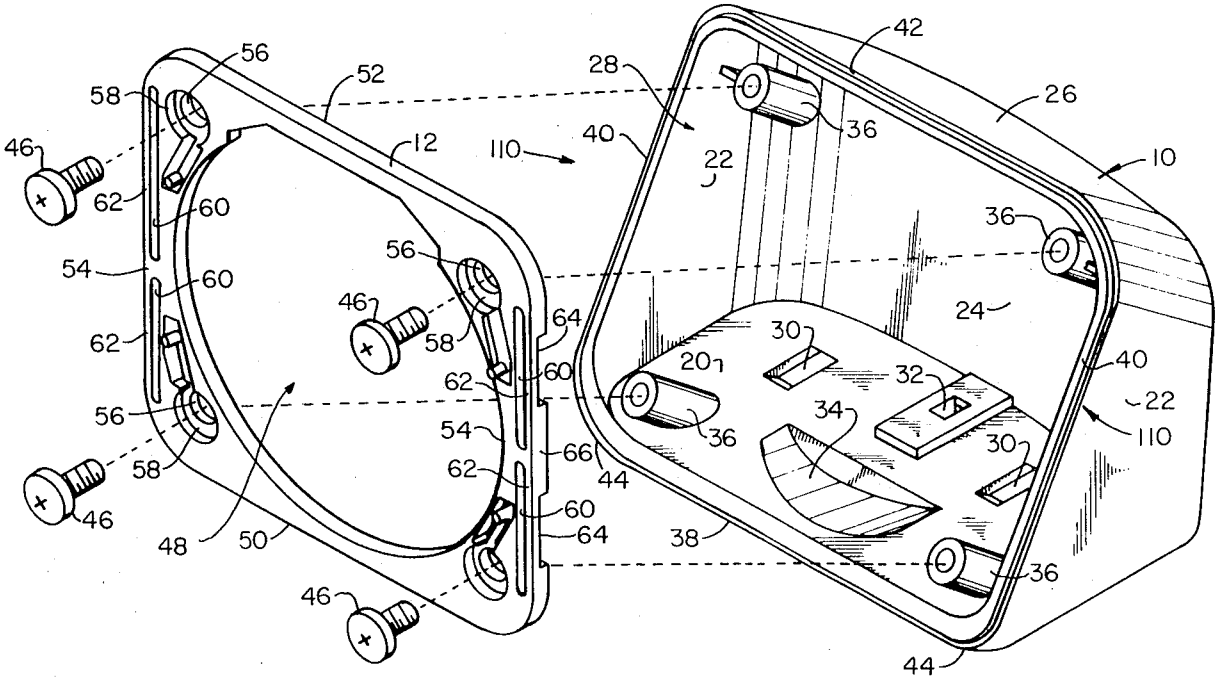
FIG. 2 shows an exploded perspective view of the casing and gasket of the preferred embodiment of the electro-acoustic transducer assembly of the present invention.

The casing 10 shown in FIGS. 1, 2 and 7 is essentially a hollow shell including a flat bottom 20, side walls 22, rear wall 24, top 26 and a front opening 28. As shown in FIG. 1, the rear wall is formed at an obtuse angle to bottom 20. The rear wall 24 is preferably curved about an axis parallel to and disposed between the side walls 22 so as to increase the strength of the casing. The bottom 20 of casing 10 preferably includes a pair of openings 30 for receiving mounting screws (not shown) for mounting the casing to a supporting structure, such as an automobile door, back window shelf or dashboard. A third hole 32 is provided in bottom 20 for receiving wires for electrically connecting the transducer to an external source of audio signals, such as a radio or cassette deck. The bottom 20 is also preferably provided with an indentation 34 for receiving a portion of the magnet 98 (shown in phantom lines in FIG. 6 and described hereinafter).

A plurality of screw-threaded, tapped bosses 36 are preferably provided within casing 10 for receiving the screws 46 (shown in FIG. 2). The edge 38, edges 40 and edge 42 of the respective bottom 20, side walls 22 and top 26 define the periphery of front opening 28 of casing 10. The edges 38, 40 and 42 are provided with a collar 44 extending around the outer periphery of the edges. The edges 38, 40 and 42 define a plane of the opening 28, which plane lies adjacent to but slightly spaced from the terminal ends of bosses 36 so that the terminal ends lie just inside the casing from the defined plane.

The casing 10 is preferably formed as a single integral piece and made of a strong, impact-resistant plastic material, such as an acrylonitride butadiene styrene (ABS) compound.

The bracket 12 includes a central opening 48, shaped to receive the magnet 98 and magnet-support structure 84 provided on the closure means 14 (shown in FIG. 6), described in greater detail hereinafter. Bracket 12 is shaped similar to opening 28 of casing 10, with the dimension between the bottom and top portions 50 and 52 of bracket 12 being slightly larger than the spacing between bottom and top edges 38 and 42 of casing 10, while the dimension between side portions 54 of bracket 12 is slightly less than the spacing between side edges 40 of casing 10, for reasons which will be more apparent hereinafter. Apertures 56 are provided in bracket 12 for receiving screws 46. In this regard, apertures 56 are aligned with the tapped bosses 36 of casing 10 when the bracket is secured in place with screws 46. Each aperture 56 is provided with a counterbore 58 for forming a recess for the head of screw 46. The side portions 54 of the bracket 12 each includes a pair of spaced-apart longitudinal slits 60 aligned with one another so as to form a pair of elastically-flexible bars 62 on the outer edge of each side portion 54. The center of each bar 62 is provided with an indentation 64 on the side of bracket 12 facing the interior of casing 10 when the bracket is secured to the casing. The indentations 64 of each side portion 54 are separated by the side edge section 66.

Bracket 12 is also provided with elastic biasing means in the form of elastically-flexible tabs 68 formed in slots 70, preferably between each of the slits 60 and central opening 48, adjacent each aperture 56. One end of each tab 68 is integrally formed as part of the bracket 12 while the other end is free to move within slot 70. The free end of each tab includes a projection 72 extending perpendicular to the tab toward and in contact with the side 92 of cover 14 when the cover is secured in place, as will be more evident hereinafter. Each projection 72 is of sufficient dimension so as to contact the cover and flex the corresponding tab when the cover is in place so that when the cover is released from the bracket, in a manner described hereinafter, the projections 72 will bias the cover away from the bracket by virtue of the elastic nature of the tabs.

Bracket 12 is preferably formed as a single integral piece and is preferably made of a strong, resilient plastic material having a good elastic memory, such as nylon, or an acetal resin of the type manufactured by E.I. duPont and Nemours & Co., Inc. of Wilmington, Del. under the trademark "Delrin".

Figure 5:
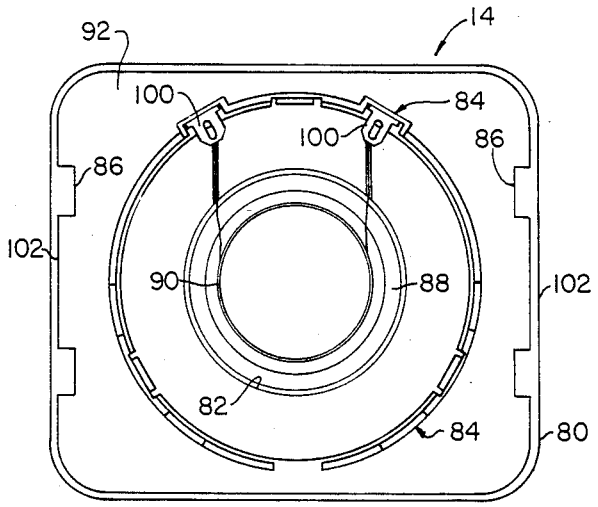
FIG. 5 shows a rear plan view of the closure means of the preferred embodiment of the electro-acoustic transducer assembly of the present invention.
Figure 6:
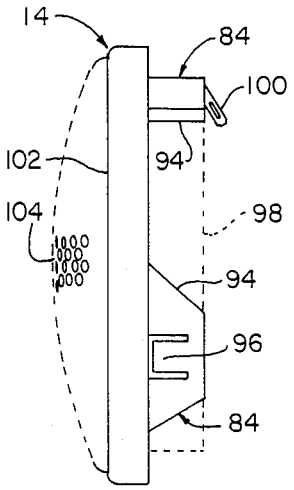
FIG. 6 is a side view of the closure means of FIG. 5.

The closure means 14, shown in detail in FIGS. 5, 6 and 7, includes a plate 80 having a central aperture 82, magnet-supporting structure 84 and tabs 86. A diaphragm 88 is secured in aperture 82. The diaphragm is of a type well-known in the art, such as a thin layer of polyamide (e.g., 0.2 mm thick), secured around the periphery of the aperture 82, and formed so that a voice coil 90 can be secured to the side 92 of plate 80 facing casing 10 when the closure means 14 is secured in place. In the preferred embodiment, the magnet-supporting structure includes at least three retaining sections 94, extending from the side 92 of plate 80, each section including an ear 96 for engaging and holding the magnet 98 in place relative to and behind the voice coil 90 and diaphragm 88 when the closure means is secured in place. A pair of terminals 100 are provided in one section 94 and are electrically connected to the voice coil 90 through suitable means, such as wires secured to the side 92 of the plate 80. Suitable electrical wiring can be secured to the terminals 100 and threaded through the hole 32 for connecton to an external source of audio signals.

Plate 80 also includes a lip 102 extending from both sides of and around the entire periphery of plate 80. The tabs 86 are preferably provided as pairs on the lip 102, each pair being provided on a corresponding side of the plate 80. The tabs 86 are inwardly directed and thus disposed substantially parallel to and spaced from the side 92 of the plate. Each pair of tabs 86 is spaced-apart and tapered so that the tabs can easily engage the opposing indentations 64 when the closure means 14 is secured in a latching position with the bracket 12, as shown in FIG. 7. The lip 102 also extends to the exterior side of plate 80, opposite side 92, so as to form a supporting peripheral edge around the plate 80 for the attachment of suitable cover means, such as grill 104, for protecting the diaphrgam 88. The grill 104 can be secured in place in any suitable manner, such as using a glue material of the type including cyanoacrylate. The plate 80, along with the magnetic-supporting structure 84, tabs 86, and peripheral lip 102, can be formed as a single integral unit of a strong impact-resistant material, such as ABS.

The system is assembled by securing the magnet 98 within the sections 94 so that it is properly positioned relative to the voice coil 90 and diaphragm 88, as shown in FIG. 6. The bracket 12 is secured to casing 10 by the screws 46. The latter are secured to bosses 36 so that the side edge section 66 between adjacent indentations 64 extends into the opening 28 of the casing adjacent the side edges 40 of the casing 10 a sufficient amount so that when opposing pressure is inwardly applied against the side walls 22 of the casing 10, in the direction of arrows 110 shown in FIG. 2, opposing forces are applied to the opposite side edge sections 66 resulting the indentations 64 moving inwardly, due to the flexible nature of the bars 62. The heads of screws 46 will be positioned within the counterbores 58 so as to be sufficiently recessed so that the screws will not interfere with closure means 14.

In order to mount the assembly to an external structure, suitable means, such as screws (not shown), are used through openings 30 of casing 10 for attaching the casing. With the magnet 98 held in the proper position relative to the voice coil 90 and diaphragm 88, tabs 86 at one side edge of plate 90 are positioned in the corresponding pair of slots provided between the respective pair of indentations 64 of gasket 12 and the adjacent edge 40 of the casing 10. The other pair of tabs 86 can then be forced into a latching engagement in the slots provided between the other indentations 64 on the other side edge of bracket 12 and the corresponding adjacent edge 40 by pushing the closure means 14 towards the casing 10 until the tabs are properly engaged.

In order to disassemble the assembly, the cover is released from the assembly shown in FIG. 1 by applying pressure in the direction of arrows 110 of FIG. 2 to opposite sides of the casing, approximately at the location of tabs 86 and indentations 64, so that at least one pair of tabs 86 disengages and is released from the slots formed by the indentations 64 of bracket 12 and the edge 40 of the casing 10. The projections 72 of tabs 68 of the bracket 12 will bias the cover away from the bracket 12 so that the cover can be more easily removed.

Since certain changes may be made in the above product without departing from the scope of the invention herein involved, it is intended that all matter contained in the above description or shown in the accompanying drawings shall be interpreted in an illustrative and not in a limiting sense.

What is claimed is:

1. In an electro-acoustic transducer assembly including a permanent magnet and a diaphragm having a voice coil bonded thereto, said assembly comprising, in combination:

a hollow casing having an opening formed in one surface thereof;

closure means for covering said opening and comprising an aperture therein in which said diaphragm is mounted, cover means mounted on one side of said closure means for protecting said diaphragm, and means for positioning said magnet on the opposite side of said closure means in proximity to said voice coil on said diaphragm;

latching means for releasably securing said closure means across said opening in said casing in a latched position with said cover means being positioned to the exterior of said assembly and said magnet being positioned in said casing, said latching means being operable by application of pressure at preselected locations on the periphery of said casing to release said closure means from said latched position; and means for elastically biasing said closure means away from said opening of said casing upon release of said closure means from said latched position, upon application of said pressure.

2. An assembly according to claim 1, wherein said means for positioning said magnet includes means for securing said magnet in contact with said voice coil.

3. An assembly according to claim 2, wherein said closure means includes a cover plate and said means for securing said magnet includes a plurality of retaining sections secured to and extending from said plate.

4. An assembly according to claim 3, wherein said retaining sections include a plurality of ears for engaging said magnet.

5. An assembly according to claim 4, wherein said plate and retaining sections are integrally formed.

6. An assembly according to claim 1, wherein said closure means includes a cover plate and said cover means includes a grill secured to said plate.

7. An assembly according to claim 1, wherein said latching means includes a mounting bracket secured between said closure means and said casing.

8. An assembly according to claim 7, wherein said latching means further includes a plurality of tabs formed on said closure means and a like plurality of slots defined at least in part by said bracket, said tabs engaging said slots when said closure means is secured in said latched position and at least some of said tabs being released from the corresponding ones of said slots upon release of said closure means from said latched position.

9. An assembly according to claim 8, wherein said bracket includes a plurality of indentations which cooperate with said casing so as to define said slots.

10. An assembly according to claim 9, wherein said bracket is dimensioned so that at least a part of said bracket in the proximity of said indentations extends into said opening of said casing adjacent said casing so that upon application of pressure to said casing in the proximity of said indentations releases at least some of said tabs from said corresponding slots.

11. An assembly according to claim 7, wherein said means for elastically biasing said closure means. away from said casing includes a plurality of flexible tabs secured to said bracket, and a projection formed on each of said tabs for engaging said closure means when said closure means is secured in said latched position.

12. An assembly according to claim 11, wherein said tabs and projections are integrally formed with said bracket.

* * * * *